US011668470B2

(12) United States Patent
Song

(10) Patent No.: US 11,668,470 B2
(45) Date of Patent: Jun. 6, 2023

(54) ELECTRIC HEATER AND COOKING APPLIANCE HAVING SAME

(71) Applicant: LG ELECTRONICS INC., Seoul (KR)

(72) Inventor: Misun Song, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 904 days.

(21) Appl. No.: 16/547,153

(22) Filed: Aug. 21, 2019

(65) Prior Publication Data

US 2020/0063977 A1 Feb. 27, 2020

(30) Foreign Application Priority Data

Aug. 21, 2018 (KR) ..... 1020180097643

(51) Int. Cl.

| | |
|---|---|
| ***F24C 7/08*** | (2006.01) |
| ***H05B 3/03*** | (2006.01) |
| ***F24C 7/06*** | (2006.01) |

(52) U.S. Cl.

CPC ..... *F24C 7/083* (2013.01); *F24C 7/067* (2013.01); *H05B 3/03* (2013.01); *H05B 2203/005* (2013.01)

(58) Field of Classification Search

CPC ... H05B 3/20; H05B 3/28; F24C 7/067; F24C 15/102

See application file for complete search history.

(56) References Cited

U.S. PATENT DOCUMENTS

| | | | | |
|---|---|---|---|---|
| 10,531,521 | B2 | 1/2020 | Korkusuz et al. | |
| 2003/0075537 | A1* | 4/2003 | Okajima ..... | H05B 3/68 219/468.1 |
| 2010/0193502 | A1 | 8/2010 | Kim et al. | |

FOREIGN PATENT DOCUMENTS

| | | | |
|---|---|---|---|
| CN | 1248384 | A | 3/2000 |
| CN | 102917484 | A | 2/2013 |
| DE | 102006022571 | A1 | 11/2007 |
| EP | 228808 | | 7/1987 |
| EP | 1013148 | B1 | 1/2002 |
| EP | 3187024 | B1 | 1/2018 |
| GB | 2322272 | A | 8/1998 |

(Continued)

OTHER PUBLICATIONS

English translation of DE 10 2006 022 571 A1 (Year: 2007).*

*Primary Examiner* — Erin E McGrath
(74) *Attorney, Agent, or Firm* — Dentons US LLP

(57) ABSTRACT

An electric heater includes a substrate; and a plane heating element disposed on one surface of the substrate. The plane heating element includes a pattern portion including a start point and an end point, which are located at an outermost side of the pattern portion, the pattern portion including a plurality of tracks having an arc shape, which are spaced apart from each other and are formed to have a length increasing from an innermost side to the outermost side of the pattern portion, and a plurality of bridges connecting the plurality of tracks in series. The plurality of bridges are formed on both sides of the pattern portion with respect to a reference line passing through a center of the pattern portion, and an innermost gap between the pair of bridges located at the innermost side of the pattern portion is narrower than an outermost gap between a pair of bridges located at the outermost side of the pattern portion.

12 Claims, 6 Drawing Sheets

(56) References Cited

FOREIGN PATENT DOCUMENTS

| | | | |
|---|---|---|---|
| JP | 2014-053574 | A | 3/2014 |
| KR | 101762159 | | 7/2017 |
| WO | 2007/131852 | A1 | 11/2007 |
| WO | 2009/014333 | A1 | 1/2009 |

* cited by examiner

ELECTRIC HEATER AND COOKING APPLIANCE HAVING SAME

CROSS-REFERENCE TO RELATED APPLICATIONS

This application claims priority to Korean Patent Application No. 10-20018-0097643, filed on Aug. 21, 2018, which is hereby incorporated by reference in its entirety.

FIELD OF THE DISCLOSURE

The present disclosure relates to an electric heater applied to a cooking appliance, and to an electric heater including a plane heating element which is capable of securing a minimum insulation gap of adjacent bridges within a limited area.

BACKGROUND

In general, a cooking appliance refers to a device for heating and cooking food using gas or electricity. Various devices such as a microwave oven using microwaves, an oven using a heater, a gas stove using gas, an electric stove using electricity, or a cooktop including a gas stove or an electric stove have come into widespread use for heating and cooking.

The gas stove directly generates flame using gas as a heating source, while the electric stove heats a container and food placed on a top plate thereof using electricity.

In the gas stove, heat loss of the flame may be large and contaminants may be discharged due to incomplete combustion, thereby polluting indoor air. Therefore, recently, electric stoves are attracting attention.

Electric stoves may be classified into an inductive electric stove which directly heats a container in which a magnetic field is generated by a magnetic induction method, and a resistive electric stove which heats a top surface made of, for example, ceramic using a hot wire.

The inductive electric stove has a short cooking time at a high temperature and uses a dedicated magnetic container. The resistive electric stove may use an existing container but has a relatively long cooking time.

Although existing resistive electric stove uses a heating element made of a nichrome wire, an electric heater using a plane heating element is being developed in order to reduce the thickness of the heating element.

In addition, in order to shorten the cooking time, a resistive electric stove using an electric heater capable of heating a limited area at a high temperature is being developed.

As an example of such an electric heater, Korean Patent Registration No. 10-1762159 B1 (published on Aug. 4, 2017) discloses a plane heating element including a substrate having a surface made of an electrically insulating material, a heating element attached to the surface of the substrate and having a predetermined shape, and a power supply for supplying electricity to the heating element.

In the electric heater, the temperature distribution of an object to be heated may be changed according to the shape (that is, the pattern) of the plane heating element, and the plane heating element may be formed in a shape capable of heating the object to be heated as uniformly as possible.

The plane heating element of the electric heater includes a plurality of tracks having a straight-line shape or an arc shape and adjacent tracks of the plurality of tracks may be connected through a bridge (or a track).

As another example of the heater, European Patent Publication No. EP 0,228,808 A2 (published on Jul. 15, 1987) discloses a temperature sensitive device. Such a device is configured by printing a heater track made of a conductive material and a plurality of electrodes on a ceramic coating layer. As current is supplied through the electrodes, radiant heat is generated in the heater track.

SUMMARY

A plane heating element includes a pattern portion in which a single hot wire is formed in a predetermined pattern shape within a limited area, and the pattern portion is configured in a symmetrical shape in a lateral direction.

Specifically, the plane heating element is configured with a plurality of tracks having an arc shape increasing from a center to an outermost side of the pattern portion, and a plurality of bridges connecting the tracks in series.

However, when current flows along the hot wire of the pattern portion, the magnitude of the voltage measured per the position of the hot wire is different and is designed to maintain the insulation gap in consideration of the potential difference between adjacent tracks or adjacent bridges.

The insulation gaps between the pair of bridges facing each other in a lateral direction are designed to be uniform, and the insulation gap may be set in consideration of the maximum potential difference between the pair of bridges.

Therefore, since the insulating gap portion between the bridges does not generate heat, the heating area is reduced, and it is difficult to uniformly generate heat at a high temperature, and since the length of a hot wire constituting a predetermined pattern in the limited area is shortened, there is a limitation in realizing required power in a limited area.

One aspect is to provide an electric heater including a plane heating element capable of optimizing a gap between bridges in consideration of a potential difference in a limited area.

Another aspect is to provide an electric heater including a plane heating element which is capable of uniformly heating at a high temperature while maximizing a heating area.

Another aspect is to provide an electric heater including a plane heating element which is capable of realizing a high required power in a limited area.

An example of the electric heater includes a substrate; and a plane heating element disposed on one surface of the substrate, in which the plane heating element includes a pattern portion including a start point and an end point, which are located at an outermost side of the pattern portion, the pattern portion includes a plurality of tracks having an arc shape, which are spaced apart from each other and are formed to have a length increasing from an innermost side to the outermost side of the pattern portion, and a plurality of bridges connecting the plurality of tracks in series, in which the plurality of bridges are formed on both sides of the pattern portion with respect to a reference line passing through a center of the pattern portion, and an innermost gap between a pair of bridges located at the innermost side of the pattern portion is narrower than an outermost gap between a pair of bridges located at the outermost side of the pattern portion.

In addition, a gap between a pair of bridges facing each other about the reference line has a length increasing toward the outermost side from the innermost side of the pattern portion.

The bridge may have an arc shape having a predetermined width.

In addition, the gap between a pair of bridges facing each other about the reference line may be set to be proportional to the potential difference between the bridges.

Another example of the electric heater includes a substrate; and a plane heating element disposed on one surface of the substrate, in which the plane heating element includes: a first pattern portion includes a start point and an end point, which are located at an outermost side of the first pattern portion; and a second pattern portion surrounding at least a portion of the first pattern portion and including a start point and an end point, which are located at an innermost side of the second pattern portion, and the first pattern portion includes a plurality of first tracks spaced apart from each other and having an arc shape to have a length increasing from a center to the outside of the first pattern portion, and a plurality of first bridges connected the plurality of first tracks in series, in which the second pattern portion includes a plurality of second tracks spaced apart from each other outside of the plurality of first tracks and having an arc shape to have a length increasing from the innermost side to an outermost side of the second pattern portion, and a plurality of second bridges connecting the plurality of second tracks in series, in which the first and second bridges are arranged on both sides of the respective first pattern portion and the second pattern portion with respect to a reference line passing through the center of the first pattern portion, and in which an innermost first gap between a pair of first bridges located at the innermost side of the first pattern portion and facing each other about the reference line is narrower than a gap between a pair of second bridges located at the second pattern portion and facing each other about the reference line.

In addition, the first gaps between the pair of first bridges, which are facing each other about the reference line, have a length increasing from the innermost side to the outermost side of the first pattern portion.

The first and second bridges may have an arc shape having a predetermined width.

In addition, the gap between the pair of first bridges facing to each other about the reference line may be set to be proportional to the potential difference between the first bridges.

In addition, the gap between the pair of second bridges facing each other about the reference line may be set to be proportional to the potential difference between the second bridges.

In addition, the plane heating element may further include a third pattern portion which surrounds at least a portion of the second pattern portion and including a start point and an end point, which are located at an outermost side of the third pattern portion, the third pattern portion includes a plurality of third tracks spaced apart from each other outside of the plurality of second tracks and having an arc shape formed to have a length increasing from an innermost side to the outermost side of the third pattern portion, and a plurality of third bridges connecting the plurality of third tracks in series, in which the third bridges are arranged on both sides of the third pattern portion with respect to the reference line passing through the center of the first pattern portion, in which the innermost gap between the pair of first bridges located at the innermost side of the first pattern is narrower than a gap between the pair of third bridges located at the third pattern portion and facing each other about the reference line.

In addition, the gap between the pair of second bridges is narrower than the gap of the pair of third bridges.

The first, second, and third bridges may be formed into arc shapes having a predetermined width.

In addition, the gap between the pair of third bridges facing each other about the reference line may be set to be proportional to the potential difference between the third bridges.

Another example of the electric heater includes a substrate; and a plane heating element formed on one surface of the substrate, in which the plane heating element includes a first pattern portion including a start point and an end point, which are located at an outermost side of the first pattern portion, and a third pattern portion surrounding at least a portion of the first pattern portion and including a start point and an end point, which are located at the outermost side of the third pattern portion, in which the first pattern portion may include a plurality of first tracks spaced apart from each other and having an arc shape formed to have a length increasing from a center to the outside of the first pattern portion and a plurality of first bridges connecting the plurality of first tracks in series, in which the third pattern portion may include a plurality of third tracks having an arc shape, which are spaced apart from each other outside of the plurality of first tracks and formed to have a length increasing from the inside to the outside of the third pattern portion, and a plurality of third bridges connecting the plurality of third tracks in series, in which the first and third bridges are formed on both sides of the respective first pattern portion and the third pattern portion with respect to a reference line passing through the center of the first pattern portion, and in which the innermost gap between the pair of first bridges located on the innermost side of the first pattern portion and facing each other about the reference line is narrower than the gap between the pair of third bridges located at the third pattern portion and facing each other about the reference line.

In addition, the first gaps between the pair of first bridges facing each other about the reference line may have a length increasing from the innermost side to the outermost side of the first pattern portion.

The first and third bridges may have arc shapes with a predetermined width.

In addition, the gap between the pair of first bridges facing each other about the reference line may be set to be proportional to the potential difference between the first bridges.

In addition, the gap between the pair of third bridges facing each other about the reference line may be set to be proportional to the potential difference between the third bridges.

The electric heater may optimize the gap between the bridges by taking the potential difference into consideration in the limited area by configuring the gap between the bridges having a small potential difference to be smaller than the gap between bridges having a large potential difference.

In addition, by arranging the bridges closely in a limited area, the heating area may be maximized and the heating area may be uniformly heated to a high temperature.

In addition, a required high power in a limited area may be realized by increasing the total hot wire length of the pattern portion including the bridges provided in a limited area.

DETAILED DESCRIPTION OF THE PREFERRED EMBODIMENTS

Hereinafter, the preferred embodiments will be described in detail with reference to the accompanying drawings. It should be understood, however, that the scope of the inventive concept of the preferred embodiments may be determined from the matters disclosed in the present disclosure, and the spirit of the present invention possessed by the preferred embodiments include implementations such as addition, deletion, modification etc., of components to the preferred embodiments.

Figure 1:
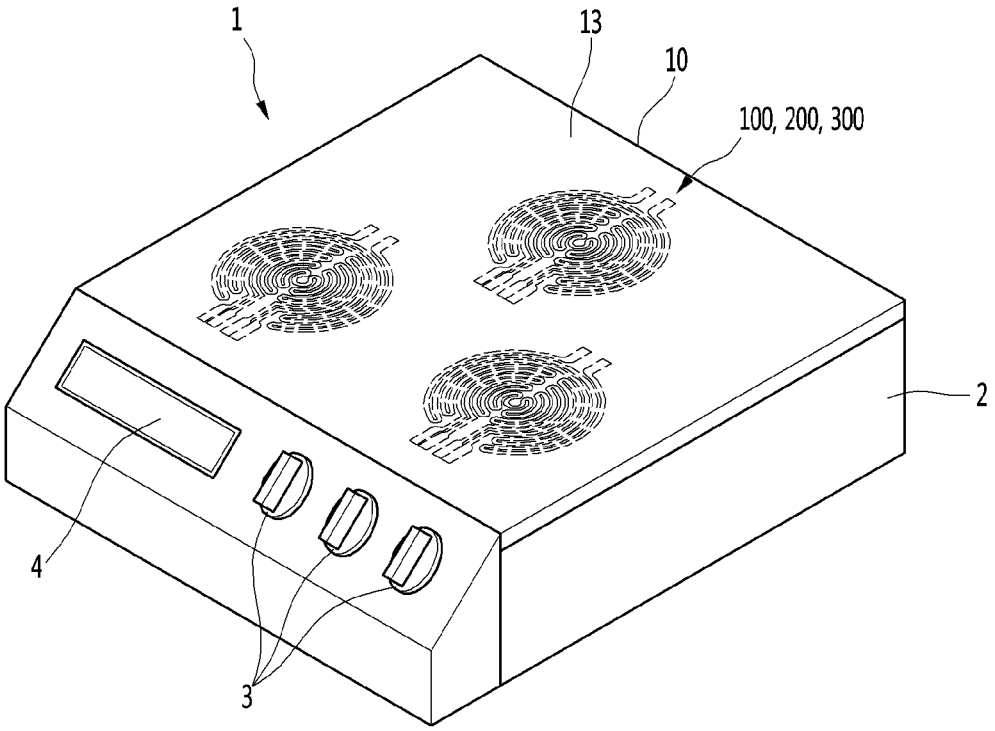
FIG. 1 is a perspective view illustrating an electric stove to which an electric heater is applied according to an embodiment of the present invention.
Figure 2:
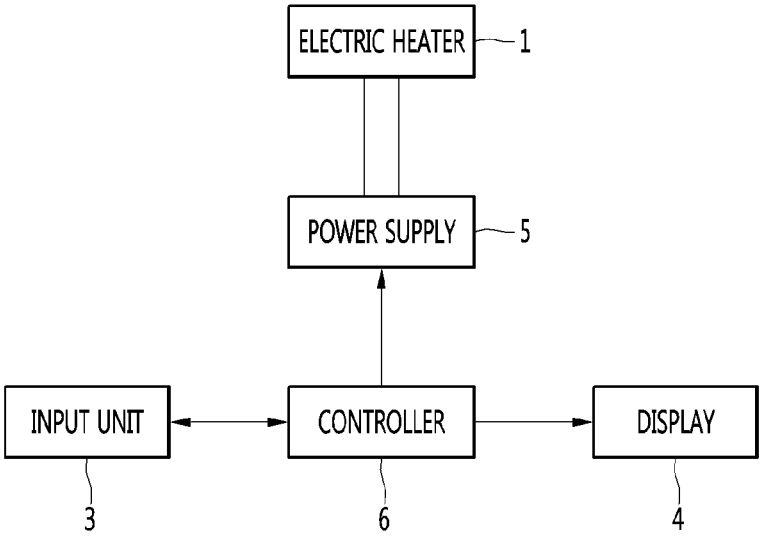
FIG. 2 is a control block diagram of an electric stove to which an electric heater according to an embodiment of the present invention is applied.

FIG. 1 is a perspective view illustrating an electric stove, to which an electric heater according to an embodiment of the present invention is applied, and FIG. 2 is a control block diagram of an electric stove, to which an electric heater according to an embodiment of the present invention is applied. The electric heater 1 of the present embodiment may configure a portion of an electric stove such as a cooktop.

The electric stove may include a case 2 forming an outer appearance. The electric heater 1 may be provided on the case 2. The upper surface of the case 2 may be opened and the electric heater 1 may be provided on the upper surface of the case 2.

The electric stove may include an input unit 3 for manipulating the electric stove and a display 4 for displaying a variety of information such as information on the electric stove. In addition, the electric stove may further include a power supply 5 connected to the electric heater 1 to apply current to the electric heater 1. Based on the configuration of the electric heater 1, the power supply may comprise of a plurality of power supplies. The electric stove may further include a controller 6 for controlling the power supply 5 and the display 4 according to input of the input unit 3. An example of the controller 6 may be a microprocessor, a digital signal processor, an electronic logic circuit, and the like. The controller 6 may control a plurality of plane heating elements 100, 200, 300 together or individually.

The electric heater 1 may be provided on the case 2 such that the upper surface thereof is exposed to the outside. An object to be heated by the electric stove may be placed on the upper surface of the electric heater 1, and the upper surface of the electric heater 1 may be a surface in which the object to be heated is seated.

Figure 3:
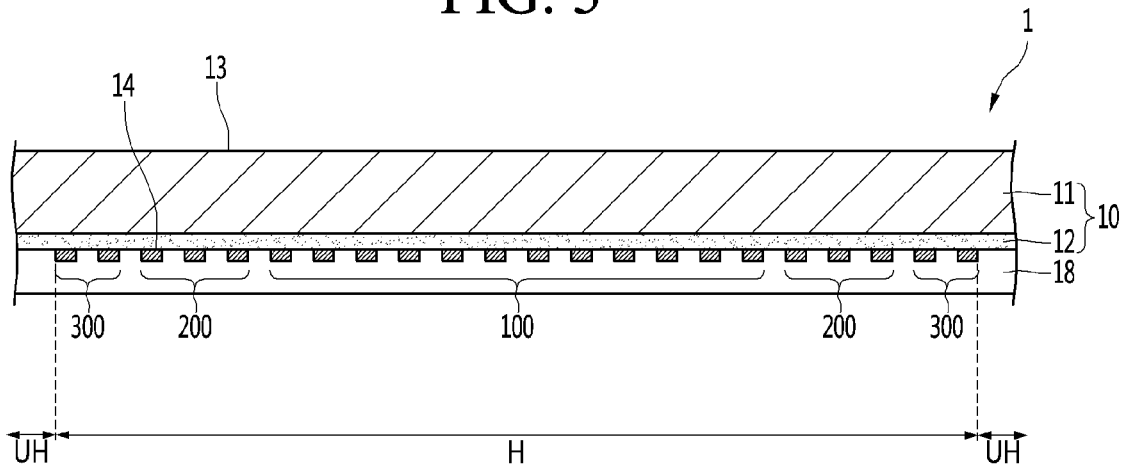
FIG. 3 is a cross-sectional view illustrating an electric heater according to an embodiment of the present invention.

FIG. 3 is a cross-sectional view illustrating an electric heater according to an embodiment of the present invention. The electric heater 1 may include a substrate 10 and a plurality of plane heating elements 100, 200, and 300 disposed on one surface of the substrate 10.

The substrate 10 may be an insulating substrate having a conductor pattern disposed on a surface thereof. An upper surface of the substrate 10 may be a surface 13 on which the object to be heated is seated. A lower surface of the substrate 10 may be a surface 14 on which the plane heating elements 100, 200, and 300 are disposed.

The substrate 10 may include only a base 11 formed of an insulating material or may include a base 11 formed of an insulating material or a non-insulating material and an insulating layer 12 disposed on one surface of the base 11. Other layers may be added to the base 11.

The base 11 may be made of glass and the insulating layer 12 may be disposed on the lower surface of the glass using a coating or a printing method, etc.

The plane heating elements 100, 200, and 300 may be directly disposed on one surface of the base 11 formed of an insulating material or may be disposed on the insulating layer 12.

The base 11 may be formed in a shape of a plate on which the object to be heated is placed or in a shape of a container in which the object to be heated is received.

The insulating layer 12 may be disposed on the lower surface of the base 11. The insulating layer 12 may be disposed on the entire lower surface of the base 11 or may be disposed on a portion of the lower surface of the base 11. The insulating layer 12 may be disposed only in a zone in which the plane heating elements 100, 200 and 300 will be disposed. The insulating layer 12 may configure the entire lower surface of the substrate 10 or a portion of the lower surface of the substrate 10.

The plane heating elements 100, 200, and 300 may be disposed on the lower surface 14 of the insulating layer 12. The plane heating elements 100, 200, and 300 may have a size smaller than the substrate 10 and the lower surface of the substrate 10 may have a heated zone H, in which the plane heating elements 100, 200 and 300 are disposed, and an unheated zone UH located around the heated zone H.

The heater 1 may further include a coating layer 18 surrounding the plane heating elements 100, 200, and 300. The coating layer 18 may be formed of an electrically insulating material to protect the plane heating elements 100, 200, and 300.

The substrate 10 of the present embodiment may be formed of a flexible material, such as a flexible insulating film. In this case, the electric heater 1 may be a flexible planar heater. Such a flexible planar heater may be attached to a member, on which the object to be heated is placed, to heat the object to be heated, like the upper plate of the electric stove.

Figure 4:
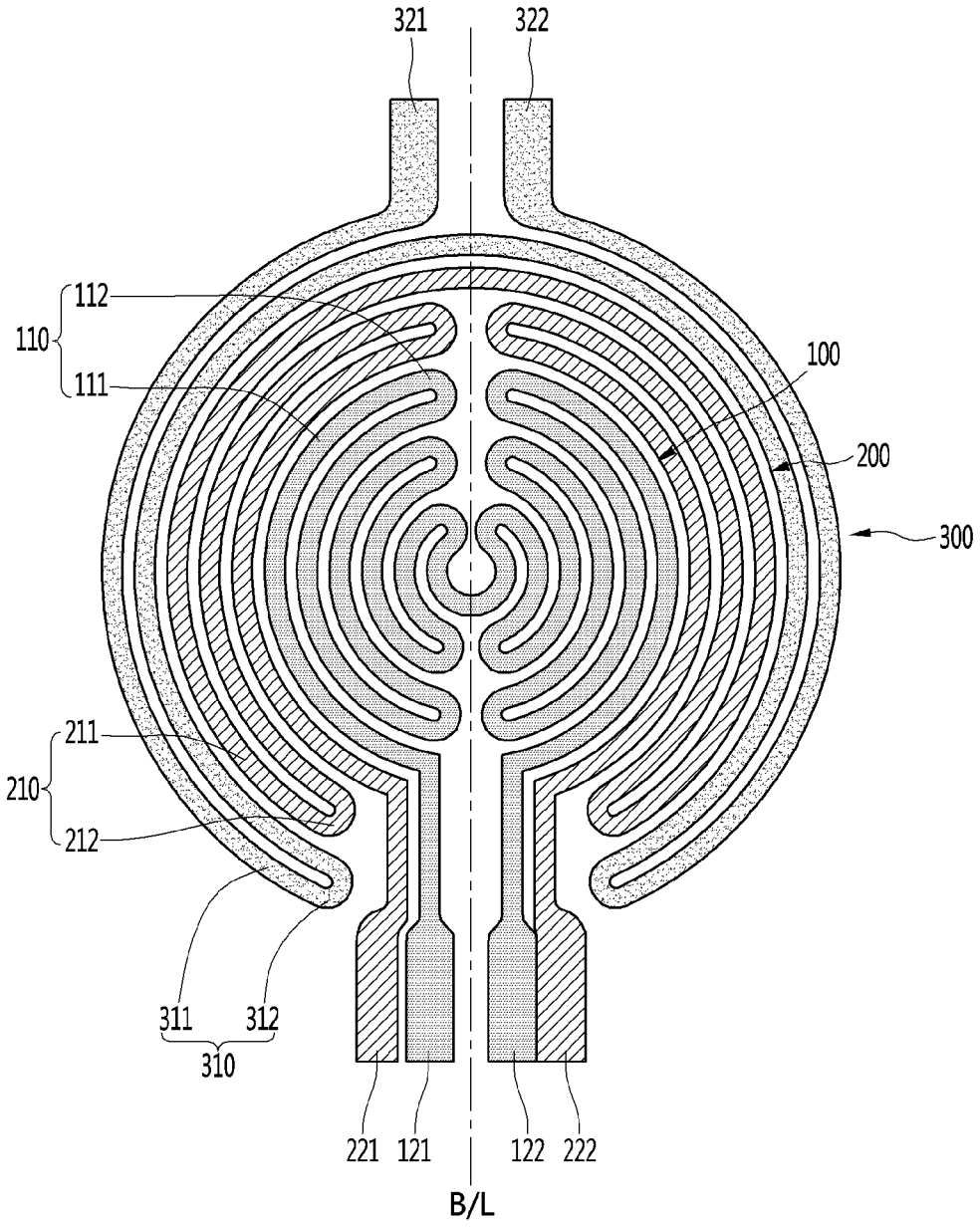
FIG. 4 is a plan view illustrating a triple-type plane heating element according to an embodiment of the present invention.

FIG. 4 is a plan view illustrating a triple-type plane heating element according to an embodiment of the present invention.

As illustrated in FIG. 4, the triple-type plane heating element according to the embodiment of the present invention includes a first plane heating element 100, a second plane heating element 200, and a third plane heating element 300 disposed on the same plane. The first plane heating element 100 is located at the center of the triple-type plane heating element, the second plane heating element 200 is located to surround the first plane heating element 100, and the third plane heating element 300 is located to surround the second plane heating element 200.

The first plane heating element 100 includes a first pattern portion 110 in which a hot wire is arranged in a predetermined shape in a circular first zone and a pair of first electrodes 120 connected to the first pattern portion 110.

The first pattern portion 110 is a heating unit which generates heat at 600° C. or more, and the hot wire constituting the first pattern portion 110 includes a start point and an end point, which are located at an outermost side of the first zone along various paths and may be configured about a reference line B/L passing through a center of the first pattern portion 110 in the lateral direction.

Of course, the first pattern portion 110 may be configured to face each other on both sides about the reference line B/L or may be variously configured in a symmetrical shape.

According to the embodiment, the first pattern portion 110 includes a plurality of first tracks 111 having an arc shape increasing in size from the center to the outermost side of the first pattern portion 110 and a first bridge 112 connecting the first tracks 111 in series.

The area where the first pattern portion 110 is disposed and the length of the hot wire constituting the first pattern portion 110 may be set to be proportional to the required power, and a gap between the first bridges 112 symmetrical to each other to be described below may be configured to be shortened to increase the heating area and to increase the required power at a limited area The first electrodes 121 and 122 are unheated units which generate heat at 200° C. or less or are hardly heated, and include a first positive electrode 121 to which a current is inputted and the first negative electrode 122 from which a current is outputted.

The first positive electrode 121 and the first negative electrode 122 are preferably unheated units and are preferably located outside the second and third pattern portions 210 and 310, which will be described later, with a predetermined gap.

The first positive electrode 121 extends from the start point of the first pattern portion 110 and the first negative electrode 122 extends from the end point of the first pattern portion 110.

However, the resistance of the first electrodes 121 and 122 is configured to be smaller than the resistance of the first pattern portion 110 in order to greatly reduce the heating temperature and may be configured to be thicker than the first pattern portion 110.

When current is supplied to the first plane heating element 100 having the above configuration, current flows sequentially along the first positive electrode 121, the first pattern portion 110, and the first negative electrode 122.

The second plane heating element 200 includes a second pattern portion 210 in which a hot wire is arranged in a predetermined shape in a second ring-shaped zone surrounding the first pattern portion 110, and a pair of second electrodes 221 and 222 connected to the second pattern portion 210.

The second pattern portion 210 is a heating unit which generates heat at 600° C. or more like the first pattern portion 110, and the hot wire constituting the second pattern portion 210 includes a start point and an end point, which are located at a second zone according to the various paths and may be configured to face each other about the reference line B/L in the lateral direction, or may be variously configured in a symmetrical shape.

According to the embodiment, the second pattern portion 210 may also include a plurality of second tracks 211 and a plurality of second bridges 212 in a symmetrical shape like the first pattern portion 110.

In order to keep a potential difference between the first and second pattern portions 110 and 120 low, it is preferable that the start point and the end point of the second pattern portion 210 is located at an innermost side of the second zone so as to be close to the start point and the end point of the first pattern portion 110.

The area where the second pattern portion 210 is disposed and the length of the hot wire constituting the second pattern portion 210 may be set to be proportional to the required power, and a gap between the second bridges 212, as will be described below, which are symmetrical to one another may be shortened, and thus it may be configured so that the heating area may be increased and the required power may be increased in a limited area.

The second electrodes 221 and 222 also are unheated units which generate heat at 200° C. or less or hardly generates heat and include a second positive electrode 221 and a second negative electrode 222.

It is preferable that the second positive electrode 221 and the second negative electrode 222 are also unheated units and are located outside the second pattern portion 210 with a predetermined gap.

The second positive electrode 221 extends from the start point of the second pattern portion 210 and the second negative electrode 222 extends from the end point of the second pattern portion 210.

However, the resistance of the second electrodes 221 and 222 is configured to be smaller than the resistance of the second pattern portion 210 in order to greatly reduce the heating temperature and may be configured to be thicker than the second pattern portion 210.

The first and second electrodes 121, 122, 221 and 222 are located in the same direction as the start point and the end point of the first and second pattern portions 110 and 210 are located adjacent to each other. In this configuration, the first positive electrode 121 and the second positive electrode 221 may be supplied with current by one power supply.

In order to keep a potential difference between the first and second electrodes 121, 122, 221 and 222 low, it is preferable that the first and second positive electrodes 121 and 221 are located adjacent to each other and the first and second negative electrodes 122 and 222 are located adjacent to each other.

When current is supplied to the second plane heating element 200 configured as described above, a current flows sequentially through the second positive electrode 221, the second pattern portion 210, and the second negative electrode 222.

The third plane heating element 300 includes a third pattern portion 310 in which a hot wire is arranged in a predetermined shape in a third ring-shaped zone surrounding the second pattern portion 210, and a pair of third electrodes 321 and 322 connected to the third pattern portion 310.

The third pattern portion 310 is also a heating unit which generates heat at 600° C. or more like the first pattern portion 110, the hot wire constituting the third pattern portion includes a start point and an end point, which are located at the third zone, and may be configured to face each other about the reference line B/L in the lateral direction, or may be variously configured in a symmetrical shape.

When the start point and the end point of the second pattern portion 210 are located at the innermost side of the second zone, it is difficult for the start point and the end point of the third pattern portion to be located close to the start point and the end point of the second pattern portion.

Therefore, in order to reduce a potential difference between the second and third pattern portions 210 and 310, it is preferable that the start point and the end point of the third pattern portion 310 are located at an outermost side of the third zone so that the start point and the end point of the third pattern portion 310 is located farthest from the start point and the end point of the second pattern portion.

The area where the third pattern portion 310 is disposed and the length of the hot wire constituting the third pattern portion 310 may be set to be proportional to the required power.

The third electrodes 321 and 322 are also an unheated unit which generates heat at 200° C. or lower or hardly generates heat, and it is preferable that the third electrodes 321 and 322 include a third positive electrode 321 and a third negative electrode 322, and is located at a predetermined gap outside the third pattern portion 310.

The third positive electrode 321 extends from the start point of the third pattern portion 310 and the third negative electrode 322 extends from the end point of the third pattern portion 310, and the third electrodes 321 and 322 may be configured to be thicker than the third pattern portion 310 in order to significantly reduce the heating temperature.

The third electrodes 321 and 322 may be located in opposite directions to the first and second electrodes 121, 122, 221, and 222, and current may be supplied to the third positive electrode 321 by the power supply connected to the first and second electrodes 121, 122, 221, and 222 or another power supply.

When current is supplied to the third plane heating element 300 configured as described above, current flows sequentially along the third positive electrode 321, the third pattern portion 310, and the third negative electrode 322.

Figure 5:
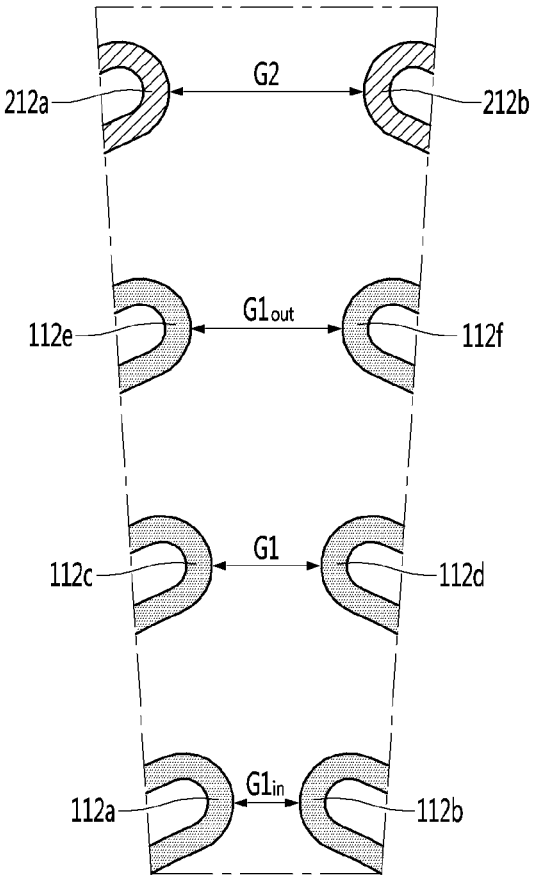
FIG. 5 is an enlarged view illustrating gaps between bridges of FIG. 4.

FIG. 5 is an enlarged view illustrating gaps between bridges of FIG. 4.

Pairs of first bridges 112*a* to 112*f* are arranged about the reference line B/L (see FIG. 4), and the pairs of first bridges may be arranged about a line from the center to the outermost side of the first zone.

When current flows from the start point to the end point of the first pattern portion 110 along the path of the first pattern portion 110, the voltage is measured to be lower toward the end point from the start point of the first pattern unit 110, thus a potential difference is small between the first bridges 112*a* and 112*b* located at the innermost side of the first zone and a potential difference is large between the first bridges 112*e* and 112*f* located at the outermost side of the first zone.

Therefore, the insulation gap is designed between the pairs of first bridges 112*a* to 112*f* adjacent to each other in consideration of the potential difference and it is preferable that the innermost first gap $G1_{in}$, which is a gap between the pair of first bridges 112*a* and 112*b* located at the innermost side of the first zone, is configured to be narrower than the outmost first gap $G1_{out}$, which is a gap between the pair of first bridges 112*e* and 112*f* located at the outermost side of the first zone.

Any first gaps of pairs of first bridges between the pair of first bridges 112*a* and 112*b* and the pair of first bridges 112*e* and 112*f* may be gradually increased from the center to the outermost side of the first zone. For example, the first gap G1 of the pair of first bridges 112*c* and 112*d* would be wider than the innermost first gap $G1_{in}$, but narrower than the outmost first gap $G1_{out}$.

Meanwhile, a pair of second bridges 212*a* and 212*b* about the reference line B/L are arranged in a symmetrical shape, and in consideration of the second ring-shaped zone, in this embodiment, only a pair of second bridges 212*a* and 212*b* is provided.

When current flows from the start point to the end point of the second pattern portion 210 along the path of the second pattern portion 210, the voltage is measured to be lower toward the end point from the start point of the second pattern unit 210, and a potential difference between the pair of second bridges 212*a* and 212*b* located in the second zone is relatively larger than the potential difference between the pair of first bridges 112*a* and 112*b* located at the innermost side of the first zone.

Therefore, it is preferable that a second gap G2, which is an insulation gap between the pair of second bridges 212*a* and 212*b* adjacent to each other, in consideration of the potential difference, is configured to be wider than the innermost first gap $G1_{in}$.

Figure 6:
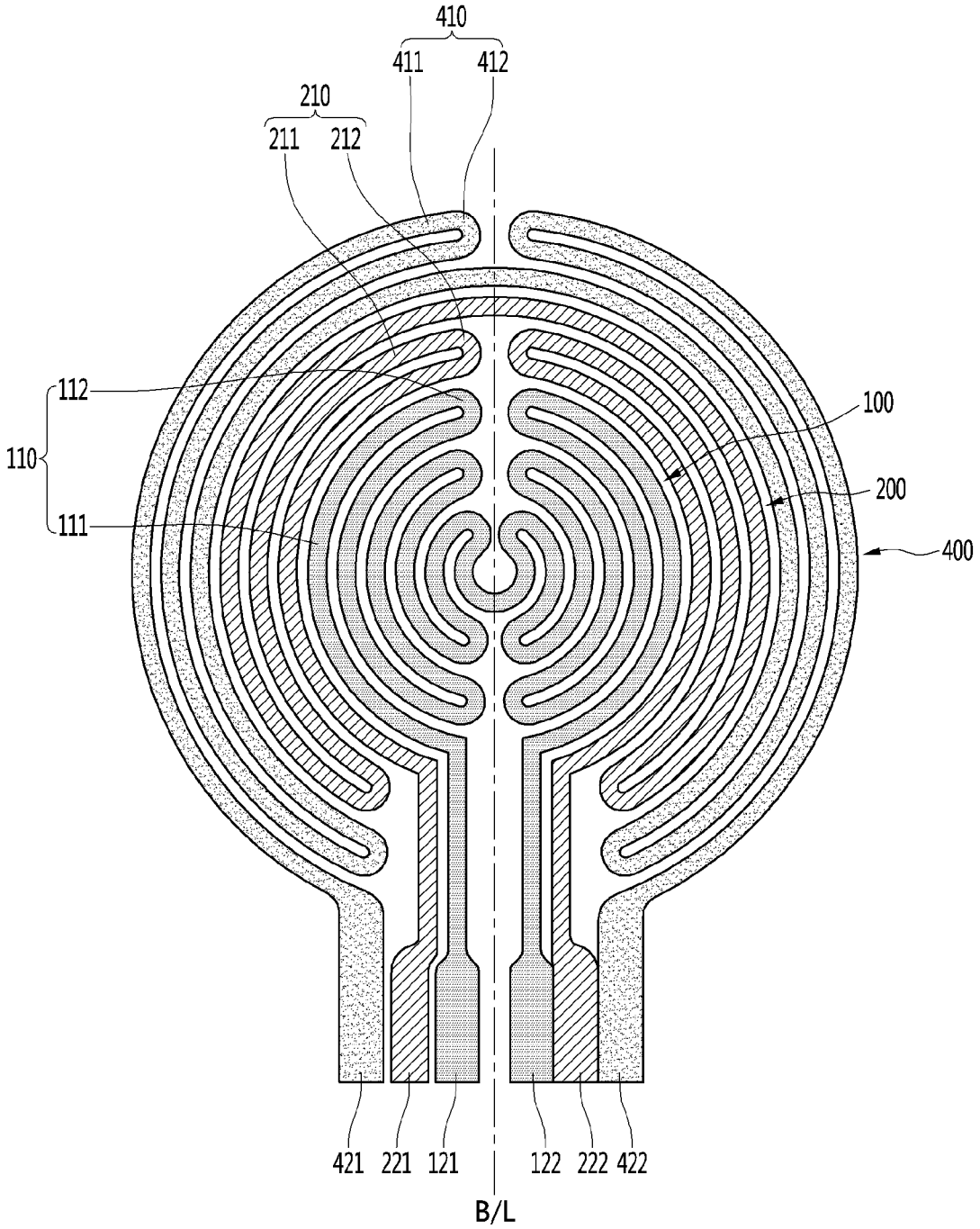
FIG. 6 is a plan view illustrating a triple-type plane heating element according to another embodiment of the present invention.

FIG. 6 is a plan view illustrating a triple-type plane heating element according to another embodiment of the present invention.

Since the electrodes of the first and second plane heating elements and the electrodes of the third plane heating element are located in different directions from each other, for example, opposite direction from each other in FIG. 4, the triple-type plane heating element according to an embodiment of the present invention may include two power supplies inside the electric stove, and a larger installation space is required inside the electric stove.

The triple-type plane heating element according to the another embodiment of the present invention is configured such that, since the electrodes 421 and 422 of the third plane heating element 400 are located in the same direction as the electrodes 121, 122, 221 and 222 of the first and second plane heating elements 100 and 200, only one power supply may be needed, and the installation space may be more compactly constructed inside the electric stove.

The first and second plane heating elements 100 and 200 are configured in the same manner as the above embodiment, and a detailed description thereof will be omitted.

The third plane heating element 400 includes a third pattern portion 410 in which a hot wire is arranged in a predetermined shape in a third ring-shaped zone surrounding the second pattern portion 210, and a pair of third electrodes 421 and 422 connected to the third pattern portion 410.

The third pattern portion 410 includes a start point and an end point, which are located at an outermost side of the third zone Z3 by one hot wire, the third pattern portion 410 includes a plurality of third tracks 411 and a plurality of third bridges 412, and may be configured in a symmetrical shape in the lateral direction.

The third electrodes 421 and 422 are composed of a third positive electrode 421 and a third negative electrode 422, and the third electrodes 421 and 422 are formed to have a significantly smaller resistance than the third pattern portion 410 so as not to generate heat at a high temperature.

The third electrodes 421 and 422 are located in the same direction as the first and second electrodes 121, 122, 221, and 222 and the first, second, and third positive electrodes 121, 221, and 421 are connected to one power supply.

It is preferable that the second and third positive electrodes 221 and 421 are located adjacent to each other and the second and third negative electrodes 222 and 422 are adjacent to each other so that a potential difference between the third electrodes and the second electrodes may be eliminated.

When current is supplied to the third plane heating element 400 configured as described above, current flows sequentially through the third positive electrode 421, the third pattern portion 410, and the third negative electrode 422.

Figure 7:
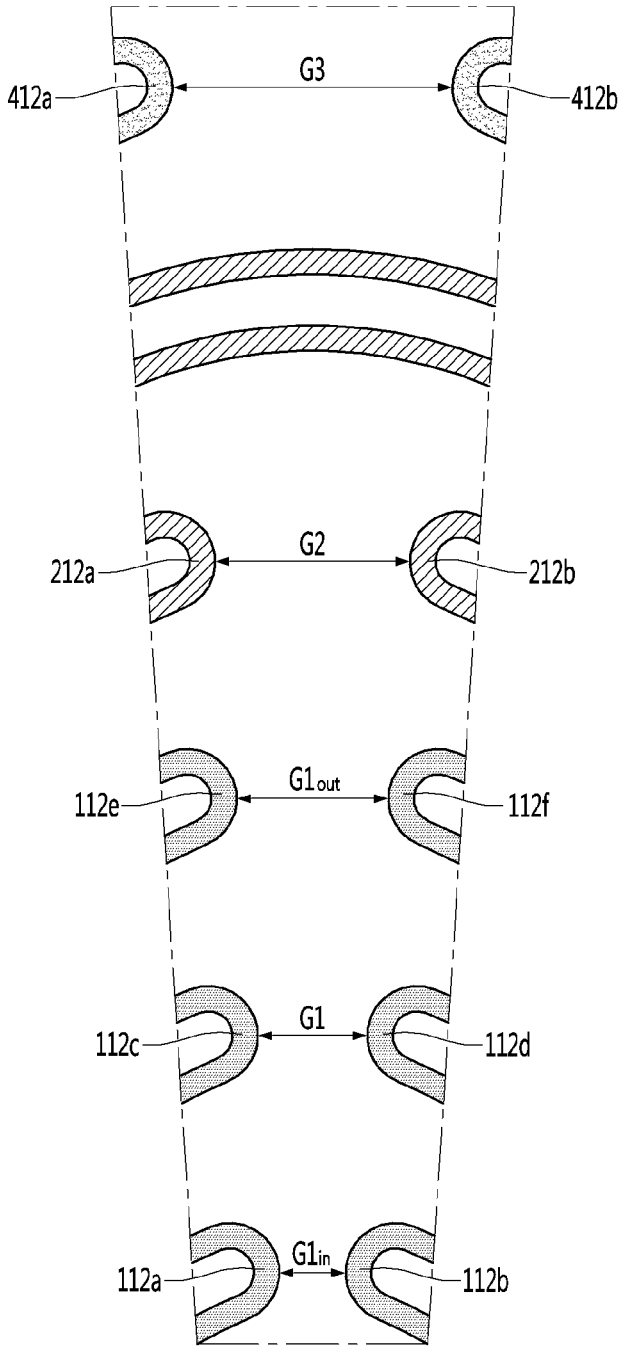
FIG. 7 is an enlarged view illustrating gaps between bridges of FIG. 6.

FIG. 7 is an enlarged view illustrating gaps between bridges of FIG. 6.

Pairs of first bridges 112*a* to 112*f* are provided about the reference line B/L (see FIG. 6), and the pairs of first bridges may be arranged about a line from the center to the outermost side of the first zone.

As described above, the insulation gaps may be designed differently between the adjacent first bridges in consideration of the potential difference, and the innermost first gap $G1_{in}$ is configured to be narrower than the outermost first gap G10*t*.

On the other hand, a pair of second bridges 212*a* and 212*b* about the reference line B/L is provided and in consideration of the second ring-shaped zone, in this embodiment, only a pair of second bridges 212*a* and 212*b* is provided.

As described above, the insulation gap may be designed between the adjacent second bridges 212*a* and 212*b* in consideration of the potential difference, and the second gap G2 is wider than the innermost first gap $G1_{in}$.

A pair of third bridges 412*a* and 412*b* is provided about the reference line B/L, and in consideration of the third ring-shaped zone, in this embodiment, only a pair of third bridges 412*a* and 412*b* is provided.

When current flows from the start point to the end point of the third pattern portion 410 along the path of the third pattern portion 410, the voltage is measured to be lower toward the end point from the start point of the third pattern unit 410, and a potential difference between the third bridges 412*a* and 412*b* located in the third zone is larger than the potential difference between the first bridges 112*a* and 112*b* located at the innermost side of the first zone.

Therefore, the third gap G3, which is an insulation gap between the adjacent third bridges 412*a* and 412*b* in consideration of the potential difference, is configured to be wider than the innermost first gap $G1_{in}$.

Meanwhile, when the potential difference between the third bridges 412*a* and 412*b* is larger than the potential difference between the second bridges 212*a* and 212*b*, the third gap G3 is configured to be wider than the second gap G2.

On the other hand, when the potential difference between the third bridges 412*a* and 412*b* is smaller than the potential difference between the second bridges 212*a* and 212*b*, the third gap G3 is configured to be narrower than the second gap G2.

As described above, the gap between the bridges adjacent to each other may be configured to be narrower in consideration of the potential difference, and the length of the hot wire arranged in a limited area may be further increased.

Therefore, the heating area may be maximized, the heat may be uniformly generated at a high temperature, and required high power may be realized in a limited area.

The present disclosure relates to an electric heater having a plurality of plane heating elements, and may be configured in various ways, such as the number and shape of the plane heating elements, and is not limited thereto. For example, more than three plane heating elements may be configured. For example, the plane heating elements may be square or rectangular shaped.

The foregoing description is merely illustrative of the technical idea of the present invention and various changes and modifications may be made by those skilled in the art without departing from the essential characteristics of the present invention.

Therefore, the embodiments disclosed in the present disclosure are intended to illustrate rather than limit the technical idea of the present invention, and the scope of the technical idea of the present invention is not limited by these embodiments.

Various features of the embodiments may be combined or excluded.

The scope of protection of the present invention should be construed according to the following claims, and all technical ideas falling within the equivalent scope to the scope of protection should be construed as falling within the scope of the present invention.

What is claimed is:

1. An electric heater comprising:

a substrate; and a plane heating element disposed on one surface of the substrate, wherein the plane heating element includes:

a pattern portion including a start point and an end point, which are located at an outermost side of the pattern portion, wherein the pattern portion includes:

a plurality of tracks having an arc shape, which are spaced apart from each other and are formed to have a length increasing from an innermost side to the outermost side of the pattern portion, and a plurality of bridges connecting the plurality of tracks in series, wherein the plurality of bridges are formed on both sides of the pattern portion with respect to a reference line passing through a center of the pattern portion, and a pair of bridges is a bridge on one side facing a bridge on an other side of the pattern portion, and wherein, for each two adjacent pairs of bridges, a gap between a pair of bridges and a gap between an adjacent pair of bridges have a width increasing from the innermost side to the outermost side of the pattern portion.

2. The electric heater of claim 1, wherein the plurality of bridges have an arc shape with a predetermined width.

3. The electric heater of claim 1, wherein a gap between a pair of bridges is set to be proportional to a potential difference between the pair of bridges.

4. An electric heater comprising:

a substrate; and a plane heating element disposed on one surface of the substrate, wherein the plane heating element includes:

a first pattern portion including a start point and an end point, which are located at an outermost side of the first pattern portion, and a second pattern portion surrounding at least a portion of the first pattern portion and including a start point and an end point, which are located at an innermost side of the second pattern portion.

wherein the first pattern portion includes:

a plurality of first tracks having an arc shape, which are spaced apart from each other and are formed to have a length increasing from an innermost side to the outermost side of the first pattern portion, and a plurality of first bridges connecting the plurality of first tracks in series, wherein the second pattern portion includes:

a plurality of second tracks having an arc shape, which are spaced apart from each other at an outside of the plurality of first tracks and are formed to have a length increasing from the innermost side to an outermost side of the second pattern portion, and a plurality of second bridges connecting the plurality of second tracks in series, and wherein the plurality of first and second bridges are formed on both sides of the respective first pattern portion and the second pattern portion with respect to a reference line passing through a center of the first pattern portion, and a pair of bridges is a bridge on one side facing a bridge on an other side of a pattern portion, and wherein, for each two adjacent pairs of first bridges, a gap between a pair of first bridges and a gap between an adjacent pair of first bridges have a width increasing from the innermost side to the outermost side of the first pattern portion.

5. The electric heater of claim 4, wherein the plurality of first and second bridges have an arc shape with a predetermined width.

6. The electric heater of claim 4, wherein a gap between a pair of first bridges is set to be proportional to a potential difference between the pair of first bridges.

7. The electric heater of claim 4, wherein a gap between a pair of second bridges is set to be proportional to a potential difference between the pair of second bridges.

8. The electric heater of claim 4, wherein the plane heating element further includes:

a third pattern portion surrounding at least a portion of the second pattern portion and including a start point and an end point, which are located at an outermost side of the third pattern portion, wherein the third pattern portion includes:

a plurality of third tracks having an arc shape, which are spaced apart from each other at an outside of the plurality of second tracks and are formed to have a length increasing from an innermost side to the outermost side of the third pattern portion, and a plurality of third bridges connecting the plurality of third tracks in series, wherein the plurality of third bridges are formed on both sides of the third pattern portion with respect to the reference line passing through the center of the first pattern portion, and wherein an innermost gap between the pair of first bridges located at the innermost side of the first pattern portion is narrower than a gap between a pair of third bridges located at the third pattern portion.

9. The electric heater of claim 8, wherein the gap between the pair of second bridges is narrower than the gap of the pair of third bridges.

10. The electric heater of claim 8,

Wherein the gap between the pair of second bridges is wider than the gap of the pair of third bridges.

11. The electric heater of claim 8, wherein the plurality of third bridges have an arc shape with a predetermined width.

12. The electric heater of claim 8, wherein a gap between a pair of third bridges is set to be proportional to a potential difference between the pair of third bridges.

* * * * *